US006530205B1

(12) United States Patent
Gentry et al.

(10) Patent No.: US 6,530,205 B1
(45) Date of Patent: Mar. 11, 2003

(54) METHOD OF AND APPARATUS FOR MAKING TWISTED CABLE AND THE CABLE PRODUCED THEREBY

(75) Inventors: Bobby C. Gentry, Carrollton, GA (US); Jerry M. Hesterlee, Carrollton, GA (US); Clinton E. Watkins, Villa Rica, GA (US); James H. Sullivan, Carrollton, GA (US)

(73) Assignee: Southwire Company, Carrollton, GA (US)

( * ) Notice: Subject to any disclaimer, the term of this patent is extended or adjusted under 35 U.S.C. 154(b) by 0 days.

(21) Appl. No.: 09/538,587

(22) Filed: Mar. 27, 2000

Related U.S. Application Data

(62) Division of application No. 09/139,557, filed on Aug. 25, 1998.

(51) Int. Cl.[7] ..... H01B 7/00
(52) U.S. Cl. ..... 57/237; 57/200; 174/126.1
(58) Field of Search ..... 57/200, 236, 237; 174/1, 70 R, 110 R, 126.1, 126.4, 128.1, 128.2, 113 R

(56) References Cited

U.S. PATENT DOCUMENTS

| | | | |
|---|---|---|---|
| 1,698,704 | A | 1/1929 | Middleton et al. |
| 4,171,609 | A | 10/1979 | Feese |
| 4,328,664 | A | 5/1982 | Vogelsberg et al. |
| 4,426,837 | A | 1/1984 | Meilenner et al. |
| 4,707,977 | A | 11/1987 | Counsin et al. |
| 5,061,821 | A | 10/1991 | Nercessian |
| 5,239,813 | A | 8/1993 | Baumgarten |
| 5,306,868 | A | 4/1994 | Faust et al. |
| 5,659,152 | A * | 8/1997 | Horie et al. ..... 174/113 R |

FOREIGN PATENT DOCUMENTS

| | | |
|---|---|---|
| WO | PCT/US99/19364 | 8/1999 |
| WO | WO 00/11248 | 3/2000 |

* cited by examiner

*Primary Examiner*—John J. Calvert
*Assistant Examiner*—Shaun R Hurley
(74) *Attorney, Agent, or Firm*—Smith, Gambrell & Russell, LLP

(57) ABSTRACT

A method of and an apparatus for making twisted electrical cable, such as 600 volt secondary distribution (UD) cable, and the twisted cable product are disclosed. The apparatus comprises a first plurality of stationary payoff reels each wound with a length of stranded bare wire conductor. The stranded conductors are simultaneously payed off the reels to a pay out accumulator for accumulating a portion of the stranded conductors during replacement of spent pay out reels. An extruder apparatus arranged downstream of the accumulator applies a plastic insulation material to a respective stranded conductor as it passes through the extruder. A cooling trough through which water is flowed cools the plastic insulation. A take-up accumulator arranged downstream of the cooling trough accumulates a portion of each insulated conductor during changeover of the take-up arranged downstream of the take-up accumulator. The take-up is rotated about a first axis to twist each insulated conductor about its longitudinal axis and to simultaneously twist the insulated conductors about one another to form a twisted electrical cable. The take-up is also rotated about a second axis for taking up the twisted electrical cable. The twisted electrical cable product made according to the method of the invention comprises a plurality of insulated conductors each twisted about its longitudinal axis by the apparatus of the invention and twisted about one another.

12 Claims, 1 Drawing Sheet

METHOD OF AND APPARATUS FOR MAKING TWISTED CABLE AND THE CABLE PRODUCED THEREBY

This is a division of application Ser. No. 09/139,557, filed Aug. 25, 1998.

FIELD OF THE INVENTION

The present invention relates to cabling methods and apparatus, and more particularly to a method of and an apparatus for making twisted cable products, such as, for example, 600 volt secondary underground distribution (UD) cable, in a continuous in-line process.

BACKGROUND OF THE INVENTION

There are several well known methods of and apparatus making twisted electrical cable products. For example, U.S. Pat. Nos. 3,686,843; 4,133,167; 4,171,609; 4,215,529; 4,426,837; 5,239,813; and 5,557,914 disclose a few of the many different types of twisting and cabling methods and apparatus which are used for twisting conductors or wires and for making twisted electrical cables. In another conventional method, a plurality of aluminum or copper wires is stranded together into a single bare stranded conductor which is then insulated with a polymeric insulation, preferably by extrusion. The insulated stranded conductor is wound onto a reel, tested on its reel which is then stored for later use. Two or more of the reels of insulated stranded conductor are taken from storage and mounted in a cabling apparatus for simultaneous pay out. As the conductors are payed out from the reels, they are twisted together to form a twisted cable and the twisted cable is taken up on a reel. Typically, each insulated conductor is payed off its reel in an untwisted condition, and the conductors are then twisted together in a planetary assembly, i.e., without each individual conductor being twisted about its own longitudinal axis.

The aforementioned conventional method has been used heretofore to manufacture secondary electrical distribution cable, such as, for example, 600 volt triplex UD cable, and represents the state-of-the-art for manufacture of such cable. One disadvantage of the conventional method is large number of manufacturing steps involved in the manufacture of the cable. The number of manufacturing steps is increased in part because of the requirement to provide in-process handling and inventory control of the large reels of uninsulated bare stranded conductors, which typically comprise 7, 19 or 37 individual copper or aluminum wires, as well as in-process handling and inventory control for the same large reels after the insulation material has been extruded onto the uninsulated bare stranded conductors and cured to form the insulated conductors that are subsequently cabled together into the twisted electrical distribution cable. Substantial in-process storage space is also required for both the large reels of bare stranded conductors, as well as for the equally large reels of insulated stranded conductors. In addition, each extrusion line for applying the plastic insulation. to the stranded conductors requires substantial plant floor space for the equipment necessary to unreel the bare stranded conductor, extrude the insulation onto the stranded conductor, and take-up the insulated stranded conductor on a reel. Substantial floor space is especially required for the cooling troughs necessary to cool the insulation material before the insulated stranded conductor is taken up onto a reel.

It would be desirable, therefore, to provide a method and an apparatus that reduces the in-process handling steps, the in-process storage and plant floor space requirements necessary for the conventional method and apparatus for making twisted electrical cable, such as 600 volt UD cable.

SUMMARY OF THE INVENTION

In view of the foregoing limitations and shortcomings of the prior art methods and apparatus, as well as other disadvantages not specifically mentioned above, there is still a need in the art to improve the processing of and the apparatus for manufacturing twisted electrical cable. The present invention is directed to an improved method of and an apparatus for making twisted cable and the cable manufactured thereby. The method and apparatus of the invention overcome most, if not all, the disadvantages of the prior art methods and apparatus as more fully described hereinafter.

According to the broadest aspects of the method and apparatus of the present invention, a plurality of reels containing bare stranded conductors, e.g., 19 wire stranded aluminum conductors, are mounted for simultaneous pay out of the bare stranded conductors from a plurality of stationary pay out stations. Means are provided for the simultaneous changeover or replacement of spent pay out reels with a new set of full reels of stranded conductors, including a welding station for welding the trailing end of a payed out stranded conductor to the leading end of a stranded conductor to be payed out. The bare stranded conductors are fed from the pay out stations to a plurality of pay out accumulators, one for each pay out station, where the conductors are accumulated during the simultaneous changeover of the stationary pay out reels and welding of the stranded conductor ends between reels.

Each of the plurality of bare stranded conductors is fed from a respective pay out accumulator separately to an extrusion station where a plastic insulation material, such as silane XLPE, is extruded onto each stranded conductor. In the case of the manufacture of a 600 volt triplex UD cable, the extrusion station would include either three separate extruders each feeding a respective extrusion crosshead and extrusion die or a single extruder feeding a single extrusion crosshead with multiple (three) separate extrusion dies. Preferably, a conventional stripe extruder is provided at the extrusion station for extruding surface striping, e.g., three stripes 120° apart, on one of the three extruded plastic insulations to identify the neutral conductor. The locations of the welds in each stranded conductor are marked downstream of the extruders for a purpose to be described.

After the plastic insulation is extruded onto each stranded conductor, the plastic insulation is cooled by passing the insulated stranded conductors simultaneously through a common water cooling trough downstream of the extruder station. The individual insulated stranded conductors are then fed downstream to a respective take-up accumulator used to accumulate the insulated stranded conductors during changeover of the twisted cable take-up reel. From the take-up accumulators, the insulated stranded conductors are guided through a closing die and thence to a rotating take-up capstan and a take-up means which rotates the finished cable. Rotation of the take-up capstan and take-up means twists each individual insulated stranded conductor about its longitudinal axis and the plurality (three) of insulated stranded conductors about each other as the take-up means simultaneously takes up the twisted cable. When the marked welds in the individual insulated stranded conductors of the twisted cable approach the take-up reel, reeling is stopped and the insulated stranded conductors are accumulated on the take-up accumulators. The welds are then cut from the twisted cable and at the same time the full take-up reel is removed and replaced by an empty take-up reel.

Because the finished twisted cable cannot have any welds in the conductors, the welds are cut out of the conductors of the finished twisted cable. Accordingly, the welds between the trailing ends of the conductors on spent pay out reels and the leading ends of the conductors on replacement pay out reels must pass through the cabling apparatus at substantially the same time, i.e., at the same longitudinal positions relative to one another. If the welds in each insulated conductor are longitudinally spaced from one another a substantial distance during manufacture of the twisted cable, a large section of the twisted cable must be cut out and scrapped to insure that no welds remain in the finished twisted cable. For that reason, the welding operations for connecting the conductors payed out from the stationary pay out reels are preferably simultaneously performed on all conductors at the same upstream location to avoid unnecessary scrap of the finished twisted cable.

With the foregoing and other advantages and features of the invention that will become hereinafter apparent, the nature of the invention may be more clearly understood by reference to the following detailed description of the invention, the appended claims and the several views illustrated in the drawings.

DETAILED DESCRIPTION OF THE INVENTION

Figure 1:
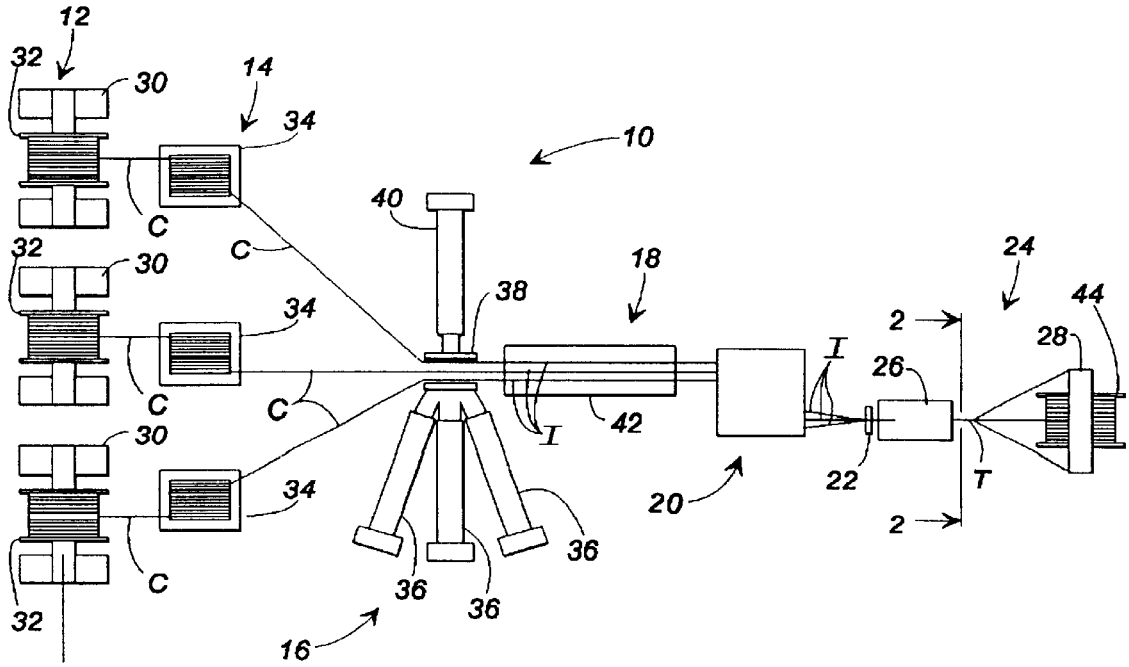
FIG. 1 is a schematic top view of the apparatus of the present invention.

Referring now to the drawings, there is illustrated in FIG. 1 a cabling apparatus according to the present invention which is designated generally by reference numeral 10. Generally, apparatus 10 comprises, from upstream to downstream, a pay out station 12, a pay out accumulator station 14, an extrusion station 16, a cooling station 18, a take-up accumulator station 20, a closing die 22, and a take-up station 24 which includes a rotating pull-out capstan 26 and rotating take-up station 28. In the schematic of FIG. 1, the pay out station 12 comprises a plurality of stationary reel pay out apparatus 30, each supporting a pay out reel 32 on which is wound a bare stranded conductor, e.g., a 19 strand aluminum wire conductor. As used herein, the term stationary pay out reel means that the pay out axis X of each reel is fixed and is not rotated about an axis perpendicular to the pay out axis X.

The bare stranded conductors C are simultaneously payed off the reels 32 to the pay out accumulator station 14 which in the schematic of FIG. 1 includes a pay out accumulator 34 for each conductor C. From the pay out accumulators 34, the bare stranded conductors C travel together to the extrusion station 16 where extrusion means, such as individual extruders 36 supply a molten plastic insulating material to separate extrusion dies. The plastic insulation material is extruded onto the bare stranded conductors passing through the extrusion dies. The plastic insulating material may be any suitable insulating material, such as silane XLPE.

In the FIG. 1 schematic, each of the extruders 36 supplies molten insulating material to one of three extrusion dies (not shown) located in a single crosshead 38. It will be understood by those skilled in the art that it is also possible that the extrusion dies in the single crosshead 38 could be supplied with molten plastic by a single large extruder or that the extrusion station 16 comprises three different crossheads, one for each conductor and each being supplied with insulating material by a separate extruder. The three crossheads 38 could also be transversely and longitudinally offset from one another or transversely offset from but longitudinally aligned with one another.

A separate stripe extruder 40 may also be provided at the extrusion station 16 for the purpose of extruding one or more plastic stripes on the surface of the insulation of the conductor that is to be the neutral conductor of the finished twisted cable. Conventionally, three stripes spaced apart 120° of a plastic material having a different color than the insulating plastic are extruded onto the surface of the insulated neutral conductor to identify it.

As the insulated stranded conductors I leave the extrusion station 16, they enter the cooling station 18 comprising a trough 42 through which is flowed water at a temperature range of about 10° C. to about 90° C. which cools the extruded insulation on the conductors I. The temperature of the cooling water may decrease from the inlet to the outlet of the cooling trough. From the water trough 42, the three insulated conductors I pass to the take-up accumulation station 20 where they are accumulated during changeover of the take-up reel.

The insulated conductors I are next guided to the closing die 22 from the take-up accumulator 20 and then to the pull out capstan 26 and take-up 28 both of which are rotated in synchronism to twist the three insulated conductors together and simultaneously twist each insulated conductor about its own longitudinal axis. The take-up 28 rotatably supports a take-up means, such as take-up reel 44 which takes-up the finished twisted cable T.

It will be appreciated by those skilled in the art that the twist of the three insulated conductors I about one another extends upstream from the rotating capstan 26 and rotating take-up 28 to the closing die and the twist imparted to the individual conductors about their respective longitudinal axes may extend upstream past the closing die 22 to the take-up accumulator 20.

Figure 2:
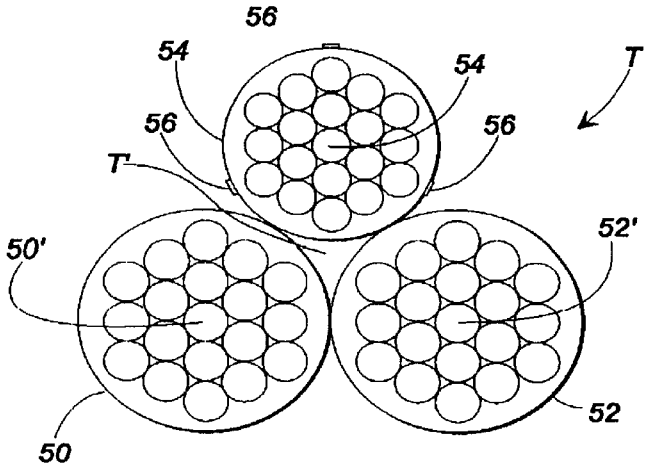
FIG. 2 is a cross-sectional view of one embodiment of a twisted cable made according to the method of the present invention using the apparatus schematically shown in FIG. 1 and taken along line 2—2 of FIG. 1.

FIG. 2 illustrates in a cross-section taken at line 2—2 of FIG. 1 the finished twisted cable T which, in the example of FIG. 2, has two nineteen (19) wire stranded conductors 50, 52 of a first given diameter and a third nineteen (19) wire stranded conductor 54 of a diameter smaller than the diameter of conductors 50 and 52. The smaller diameter of the conductor 54 is the result of using smaller diameter wires for the neutral conductor 54. Neutral conductor 54 has on the surface thereof three extruded stripes 56 applied by the stripe extruder 40.

Unlike conventional twisted cable in which the individual stranded conductors are twisted about one another in a planetary assembly, the individual conductors 50, 52 and 54 of the cable T shown in FIG. 2 are twisted in a non-planetary manner about their own axes 50', 52' and 54', as well as twisted together about the axis T' of the cable T. The external appearance of the cable T made according to the method of the present invention differs from that of the cable made according to the conventional method only in that the stripes 56 on the neutral conductor 54 are helically oriented on the conductor 54 because of the twisting of the conductor about its own axis 54'. To compensate for any tendency of the finished twisted cable T to form kinks or cobbles upon pay out because of the twist in the individual conductors about their own axes, each insulated conductor is preferably subjected to pretwisting prior to take-up.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A twisted electrical cable produced by:

simultaneously paying off a first plurality of stranded bare wire conductors each having upstream and downstream ends from stationary payoff reels;

accumulating a portion of the payed off stranded bare wire conductor from each payoff reel;

simultaneously extruding an insulation material onto each stranded bare wire conductor;

cooling the insulation material applied to the stranded bare wire conductors to form a plurality of insulated conductors, each insulated conductor having a longitudinal axis;

accumulating a portion of each insulated conductor;

twisting each insulated conductor about its longitudinal axis and simultaneously twisting said insulated conductors about one another to form said twisted electrical cable; and taking up said twisted electrical cable wherein the cable is formed by one of 7, 19, or 37 wires stranded together and the cable is a 600 volt electrical distribution cable.

2. The cable of claim 1, wherein the insulation is extruded by a plurality of extruders, each extruder having an extrusion die, the extruders being positioned such that the extrusion dies of said extruders are arranged in spaced relation to one another from an upstream die position to a downstream die position and are laterally offset from one another in a direction transverse to the payoff direction of said stranded bare wire conductors from said payoff reels.

3. The cable of claim 1, wherein the insulation is extruded by a plurality of extruders, each extruder having an extrusion die, the extruders being positioned such that the extrusion dies of said extruders are transversely aligned and are laterally offset from one another in a direction transverse to the payoff direction of said stranded bare wire conductors from said payoff reels.

4. The cable of claim 1, wherein said extruded insulation material is cooled by a cooling trough.

5. The cable of claim 4, formed by cooling the insulation material applied to the stranded bare wire conductors by simultaneously passing the insulated conductors through a water cooling trough after extruding the insulation material onto each stranded bare wire conductor.

6. The cable of claim 5, formed by cooling at a temperature of said water in the range of from about 10° C. to about 90° C.

7. The cable of claim 4, formed by flowing water through said cooling trough.

8. The cable of claim 7, formed by decreasing the water flowing through said cooling trough from inlet to outlet.

9. The cable of claim 1, formed by a closing die located downstream of the second accumulator and upstream of the take-up for bringing together the insulated conductors for twisting.

10. The cable of claim 1, formed by copper wires stranded together.

11. The cable of claim 1, formed by three payoff reels paying off three stranded bare wire conductors comprising aluminum wires stranded together.

12. The cable of claim 1, formed by providing a second plurality of stranded bare wire conductors each having upstream and downstream ends and welding the downstream end of each stranded bare wire conductor of said second plurality of stranded bare wire conductors to a respective upstream end of a stranded bare wire conductor of said first plurality of stranded bare wire conductors.

* * * * *